US007036400B2

(12) United States Patent
Matsumoto et al.

(10) Patent No.: US 7,036,400 B2
(45) Date of Patent: May 2, 2006

(54) WRENCH

(75) Inventors: Masakazu Matsumoto, Osaka (JP); Masahiro Taguchi, Osaka (JP); Susumu Mikado, Osaka (JP)

(73) Assignee: Nikken Kosakusho Works Ltd., Osaka-Fu (JP)

( * ) Notice: Subject to any disclaimer, the term of this patent is extended or adjusted under 35 U.S.C. 154(b) by 0 days.

(21) Appl. No.: 11/123,991

(22) Filed: May 5, 2005

(65) Prior Publication Data

US 2005/0199101 A1 Sep. 15, 2005

Related U.S. Application Data

(62) Division of application No. 10/616,285, filed on Jul. 8, 2003.

(30) Foreign Application Priority Data

Jul. 9, 2002 (JP) ..... 2002-199882

(51) Int. Cl.
*B25B 13/00* (2006.01)

(52) U.S. Cl. ..... 81/59.1; 81/60; 81/61; 81/58; 81/58.4; 192/43.2

(58) Field of Classification Search ..... 81/59.1, 81/60, 61–63, 58.4, 58.2, 58; 192/43.2, 45.1, 192/46

See application file for complete search history.

(56) References Cited

U.S. PATENT DOCUMENTS

| | | | | |
|---|---|---|---|---|
| 592,213 | A | 10/1897 | Smith | 192/44 |
| 1,412,688 | A * | 4/1922 | Layton et al. | 192/45 |
| 5,848,561 | A * | 12/1998 | Hsieh | 81/59.1 |
| 5,941,140 | A * | 8/1999 | Suksi | 81/59.1 |
| 6,112,624 | A * | 9/2000 | Chen | 81/59.1 |
| 6,253,646 | B1 * | 7/2001 | Chang | 81/59.1 |
| 6,516,688 | B1 | 2/2003 | Albertson | 81/59.1 |
| 6,530,461 | B1 * | 3/2003 | Kurita et al. | 192/44 |

FOREIGN PATENT DOCUMENTS

JP 07-068473 3/1995

* cited by examiner

*Primary Examiner*—Lee D. Wilson
*Assistant Examiner*—Anthony Ojini
(74) *Attorney, Agent, or Firm*—Ladas & Parry LLP

(57) ABSTRACT

A wrench includes a wrench body having a ring portion and a handle portion. A retainer that holds a plurality of wedge members is disposed inside the ring portion. Wedge guide grooves are formed on the inner circumferential surface of the ring portion. Each of the wedge guide grooves has a free region which maintains the corresponding wedge member in a free state, and left-hand and right-hand wedge regions each of which maintains the corresponding wedge member in a caught state. The wrench is provided with a changeover mechanism for moving the retainer to a position at which the wedge member faces the corresponding free region, a position at which the wedge member faces the corresponding left-hand wedge region, or a position at which the wedge member faces the corresponding right-hand wedge region.

5 Claims, 10 Drawing Sheets

WRENCH

CROSS-REFERENCE TO RELATED APPLICATIONS

This patent application is a divisional application of U.S. Ser. No. 10/616,285, filed on Jul. 8, 2003, which claims priority to Japanese Application No. 2002-199882, filed on Jul. 9, 2002.

BACKGROUND OF THE INVENTION

1. Field of the Invention

The present invention relates to a wrench used for tightening and loosening a fastening member such as a bolt, a nut, or a fastening sleeve for a tool holder, and more particularly, to a wrench which includes a wrench body having a ring portion to be engaged with an outer circumferential surface of the fastening member, and wedge members disposed on the inner circumferential surface of the ring portion and adapted to be caught between the inner circumferential surface of the ring portion and the outer circumferential surface of the fastening member.

2. Description of the Related Art

A fastening member, such as a bolt, a nut, or a fastening sleeve for a tool holder, is configured to be rotated in a tightening direction or a loosening direction; and such a fastening member is tightened or loosened through an operation of rotating, in the tightening or loosening direction, a wrench that is engaged with the outer circumference of the fastening member.

A conventional wrench of such a type is disclosed in, for example, Japanese Patent No. 3155888.

FIGS. 1 and 2 shows such a conventional wrench. The wrench 1 shown in FIGS. 1 and 2 includes a wrench body 3 having a ring portion 3*a* and a handle portion 3*b* formed integrally with the ring portion 3*a*. The ring portion 3*a* has a diameter suitable for disengagable engagement with the outer circumference of a fastening member 2. A plurality of grooves 5 are formed on the inner circumferential surface of the ring portion 3*a* at predetermined intervals in the circumferential direction so as to extend in the circumferential direction. A roller-shaped wedge member 4 is movably received in each of the grooves 5.

As shown in FIG. 2, each of the grooves 5 has a free region 5*a* having a relatively large depth and a wedge region 5*b* located on either side of the free region 5*a* and shallower than the free region 5*a*. Further, spring accommodation spaces 6 are formed in the ring portion 3*a* at circumferential locations corresponding to those of the grooves 5. A guide hole 7 is formed in a partition wall 6*a* between each of the spring accommodation spaces 6 and the corresponding groove 5 at a location facing the free region 5*a*. A cylindrical member 8 is disposed in the guide hole 7 to be projectable toward the corresponding groove 5. Moreover, a plate spring 9 is disposed within each of the spring accommodation spaces 6 in order to urge the corresponding cylindrical member 8 to project toward the corresponding groove 5. Therefore, before the ring portion 3*a* of the wrench 1 is engaged with the fastening member 2, as illustrated by a solid line in FIG. 2, each wedge member 4 is located in the left-hand or right-hand wedge region 5*b*, because of pressing force applied from the cylindrical member 8.

The conventional wrench 1 having the above-described configuration is used as follows. When the fastening member 2 is to be tightened by use of the wrench 1, the ring portion 3*a* of the wrench 1 is engaged with the fastening member 2, and then the wrench 1 is rotated in a direction of arrow A in FIG. 2. As result, as indicated by a solid line in FIG. 2, each wedge member 4 is pushed into the right-hand wedge region 5*b*, whereby the wedge member 4 is caught between the wall surface of the wedge region 5*b* and the outer circumferential surface of the fastening member 2, and thus the wrench 1 and the fastening member 2 are united. Therefore, the fastening member 2 is tightened through an operation of rotating the wrench 1 in the same direction.

When the fastening member 2 is to be loosened by use of the wrench 1, the ring portion 3*a* of the wrench 1 is engaged with the fastening member 2, and then the wrench 1 is rotated in a direction of arrow B in FIG. 2. As result, as indicated by an imaginary line in FIG. 2, each wedge member 4 is pushed into the left-hand wedge region 5*b*, whereby the wedge member 4 is caught between the wall surface of the wedge region 5*b* and the outer circumferential surface of the fastening member 2, and thus the wrench 1 and the fastening member 2 are united. Therefore, the fastening member 2 is loosened through an operation of rotating the wrench 1 in the same direction.

In such a conventional wrench 1, in a state in which the ring portion 3*a* of the wrench 1 is not engaged with the fastening member 2, as shown in FIG. 2, each wedge member 4 is located in the left-hand or right-hand wedge region 5*b*, because of pressing force applied from the corresponding plate spring 9 via the corresponding cylindrical member 8, and a portion of the wedge member 5 projects outward from the inner circumferential surface of the ring portion 3*a*. Therefore, when the ring portion 3*a* of the wrench body 3 is engaged with the fastening member 2, the above-mentioned projecting portion of the wedge member 4 interferes with the fastening member 2 and hinders smooth engagement of the ring portion 3*a* with the fastening member 2.

Moreover, the conventional wrench 1 is configured in such a manner that within each groove 5 the wedge member 4 is restrained in the left-hand or right-hand wedge region 5*b* by means of the corresponding plate spring 9 and the corresponding cylindrical member 8. This hinders smooth movement of the wedge member 4 within the groove 5 from one wedge region 5*b* to the other wedge region 5*b* and thus renders the movement unstable. Moreover, attainment of a state where all the wedge members 4 are located in the wedge regions 5*b* of the same side is not guaranteed; and, in some cases, some wedge members 4 are located in the left-hand wedge regions 5*b*, whereas the remaining wedge members 4 are located in the right-hand wedge regions 5*b*. In such a case, some wedge members 4 fail to operate properly, and thus hinder the operation of tightening or loosening the fastening member 2. In order to avoid such a problem, the positions of some wedge members 4 must be corrected such that all the wedge members 4 are located in the wedge regions 5*b* of the same side. Such position correction operation lowers the efficiency of work for tightening or loosening the fastening member 2.

SUMMARY OF THE INVENTION

In view of the foregoing, an object of the present invention is to provide a wrench which enables a changeover operation to move wedge members between free regions and wedge regions and which facilitates tightening or loosening of a fastening member.

The present invention provides a wrench for tightening or loosening a fastening member with respect to another member, which wrench has a changeover mechanism for moving each wedge member between a free region and a wedge region, and enables reliable and stable positioning of each wedge member at a position in which the wedge member faces the free region or a position in which the wedge member faces the wedge region, whereby all the wedge members are simultaneously and stably held in a free state or a caught state. Accordingly, tightening and loosening of a fastening member by use of the wrench can be performed without any problem. Moreover, the work for tightening and loosening of the fastening member can be facilitated, and thereby improving work efficiency.

According to the present invention, since the changeover mechanism includes a positioning mechanism of a click-stop configuration, each wedge member can be positioned, in a more reliable and stable manner, at a position in which the wedge member faces the free region or a position in which the wedge member faces the wedge region.

Further, according to the present invention, since the changeover mechanism includes a changeover lever connected to the retainer, all the wedge members can be easily brought into a free state or a caught state through mere operation of the retainer by use of the changeover lever.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will now be described with reference to the drawings.

First, a first embodiment of the present invention will be described with reference to FIG. 3 to FIG. 7C.

Figure 3:
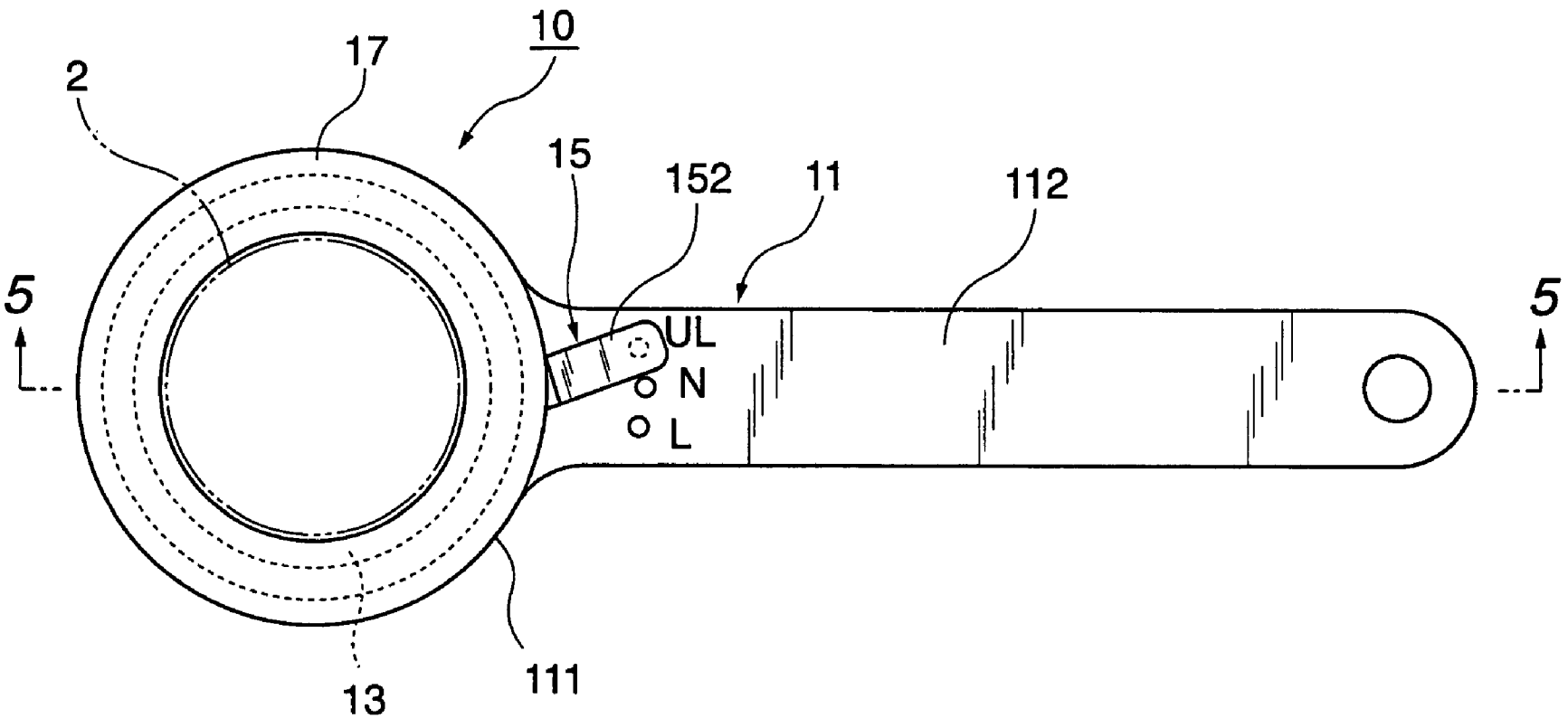
FIG. 3 is a plan view of a wrench according to a first embodiment of the present invention.
Figure 4:
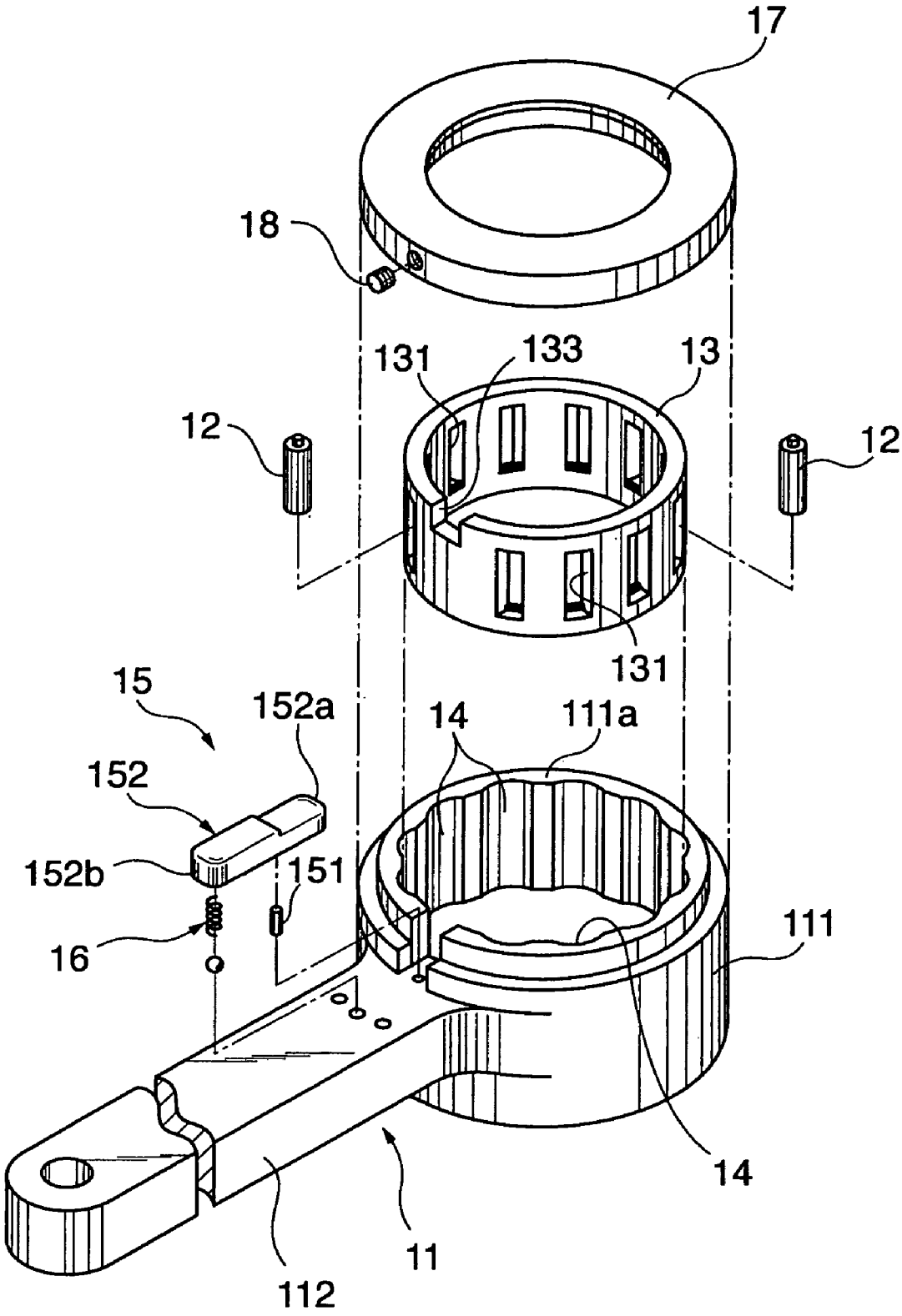
FIG. 4 is an exploded perspective view of the wrench according to the first embodiment.

A wrench 10 shown in FIGS. 3 and 4 is used to tighten or loosen a fastening member 2, such as a fastening sleeve of a tool holder. The wrench 10 includes a wrench body 11, wedge members 12, a retainer 13, wedge guide grooves 14, and a changeover mechanism 15.

The wrench body 11 has a ring portion 111, and a handle portion 112 projecting from the outer circumference of the ring portion 111. The ring portion 111 has an inner diameter suitable for disengagable engagement with the outer circumference of a fastening member 2.

As shown in FIGS. 3 to 7C, the wedge members 12 each assume a roller-like shape. When the ring portion 111 of the wrench body 11 is engaged with the outer circumference of the fastening member 2 and is rotated in order to tighten or loosen the fastening member 2, each of the wedge members 12 is caught between the inner circumferential surface of the ring portion 111 and the outer circumference of the fastening member 2 to thereby couple the ring portion 111 and the fastening member 2.

The retainer 13 is adapted to hold the wedge members 12 at uniform intervals along the inner circumferential surface of the ring portion 111. The retainer 13 is disposed inside the ring portion 111 to be rotatable along the inner circumferential surface of the ring portion 111. Reference numeral 17 denotes a ring-shaped cover member for holding the retainer 13 carrying the wedge members 12 in order to prevent the retainer 13 from coming off the ring portion 111. The cover member 17 is fitted to a stepped portion 111*a* provided at one end of the ring portion 111, and is secured to the ring portion 111 by means of a screw 18.

Figure 5:
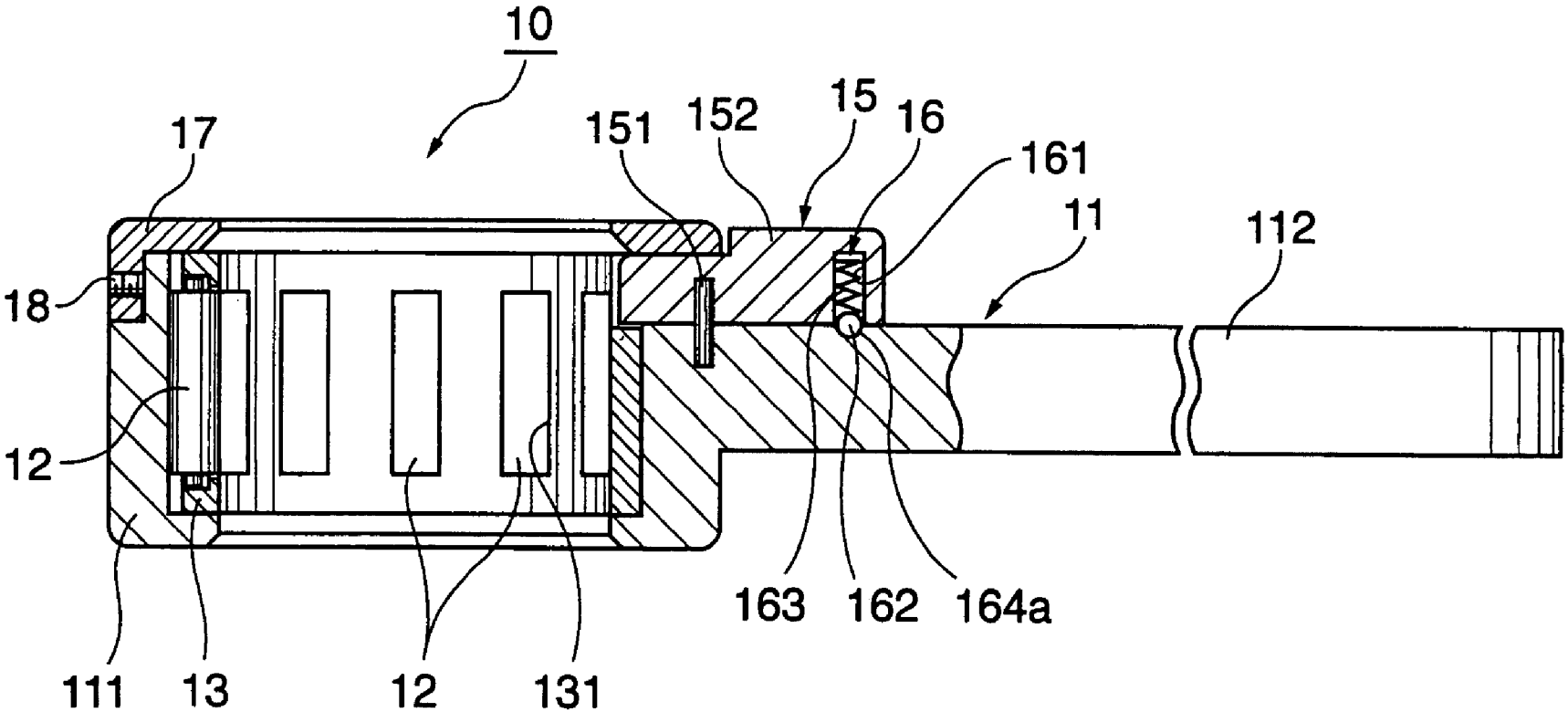
FIG. 5 is an enlarged cross-sectional view taken along line 5—5 of FIG. 3.
Figure 6:
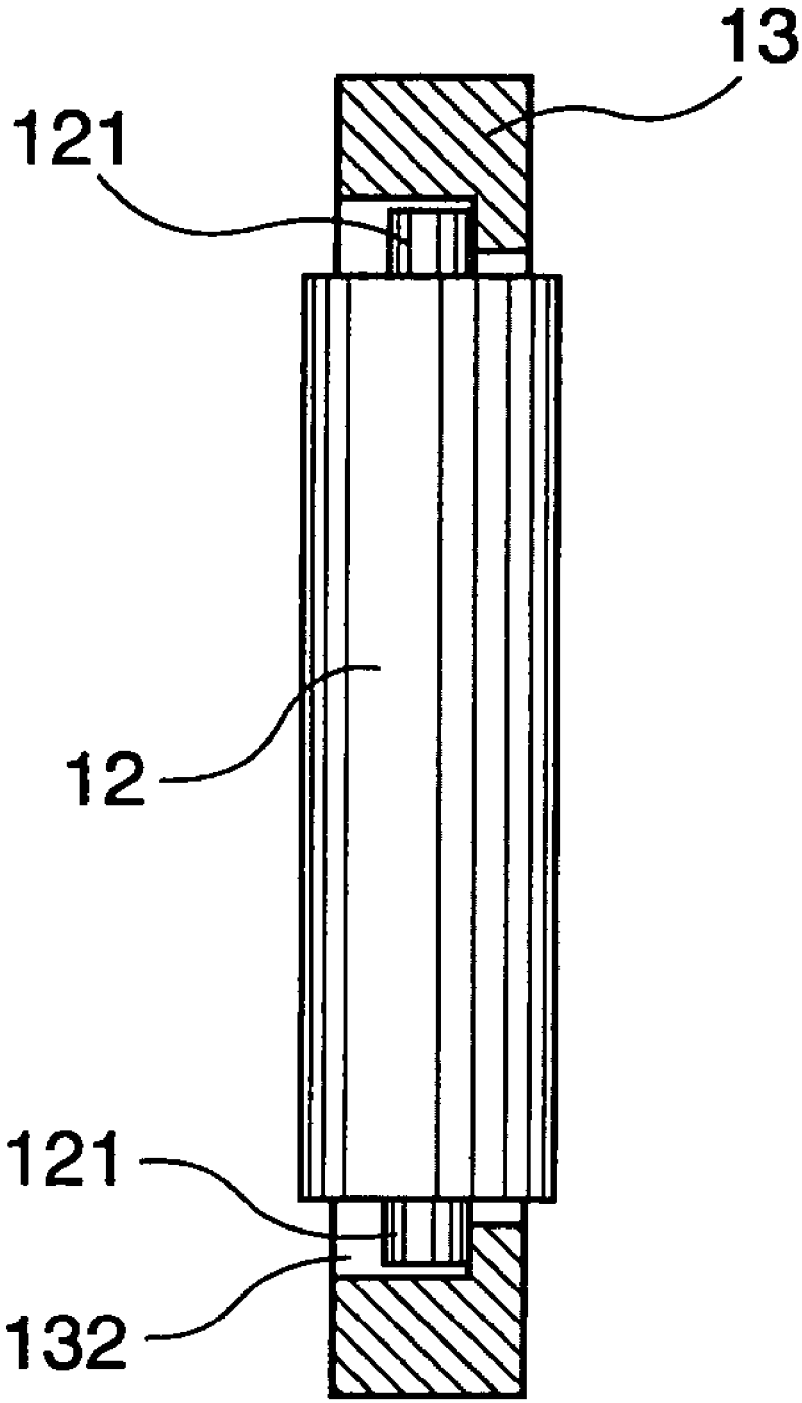
FIG. 6 is an enlarged cross-sectional view showing the relation between a wedge member and a retainer of the wrench according to the first embodiment.

More specifically, as shown in FIGS. 3 to 6, the retainer 13 assumes a cylindrical shape having a diameter corresponding to the inner diameter of the ring portion 111. The retainer 13 has a wall thickness smaller than the diameter of the roller-shaped wedge members 12. Elongated holes 131 for accommodating the wedge members 12 are formed in the retainer 13 at eleven of twelve locations which are determined, for example, by dividing the circumference of the retainer 13 at predetermined intervals of 30 degrees. The elongated holes 131 extend parallel to the axis of the retainer 13. As shown in FIGS. 6 to 7C, each wedge member 12 is movably held in the corresponding elongated hole 131 in such a manner that the wedge member 12 can be rotated about its axis. An engagement groove 132 is formed at either end of each elongated hole 131. Small-diameter boss portions 121 provided at opposite ends of each wedge member 12 are movably held in the corresponding engagement grooves 132, whereby the wedge member 12 is prevented from coming off toward the interior of the retainer 13. An engagement portion 133 to which the changeover mechanism 15 is coupled is formed at the remaining one location of the above-described twelve locations.

The wedge guide grooves 14 are adapted to maintain the wedge members 12 in a free state in which the wedge members 12 move freely between the bottoms of the wedge guide grooves 14 and the outer circumferential surface of the fastening member 2 or to maintain the wedge members 12 in a caught state in which the wedge members 12 are caught between the bottoms of the wedge guide grooves 14 and the outer circumferential surface of the fastening member 2. The wedge guide grooves 14 are formed on the inner circumferential surface of the ring portion 111 to be arranged along the circumferential direction of the ring portion 111 at intervals corresponding to those of the wedge members 12.

Figure 7A:
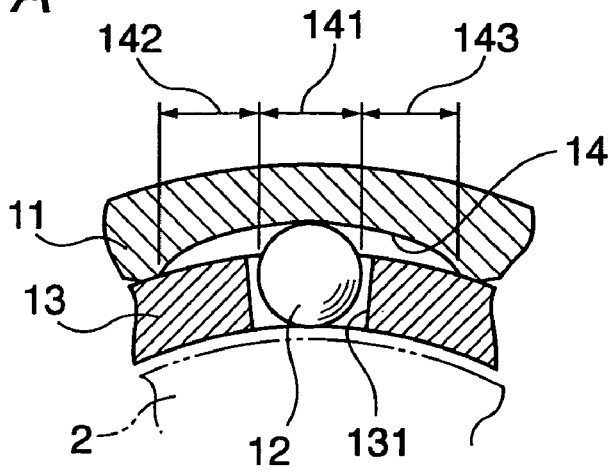
FIGS. 7A to 7C are enlarged cross-sectional views each showing the relation between a wedge member and a wedge guide groove of the wrench according to the first embodiment.
Figure 7B:
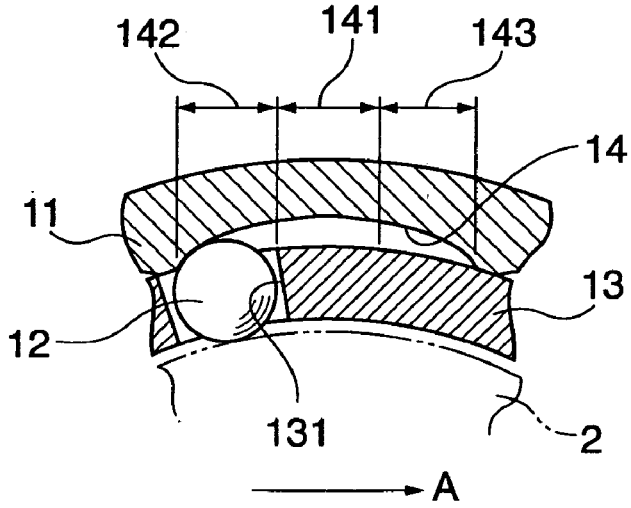
Figure 7C:
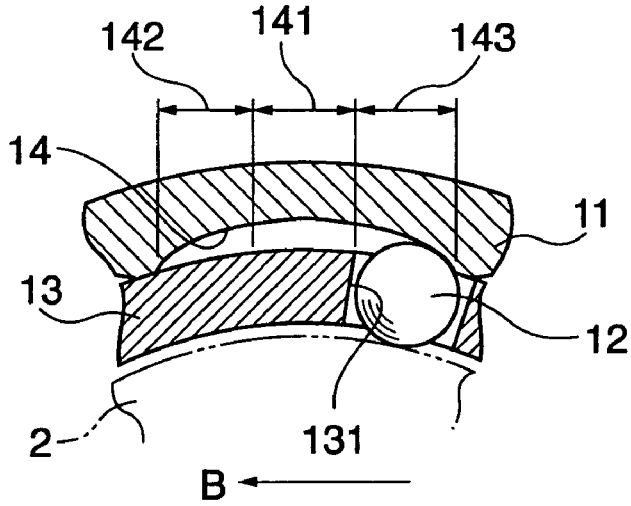

As shown in FIGS. 7A to 7C, each of the wedge guide grooves 14 has a free region 141, and left-hand and right-hand wedge regions 142 and 143 which are provided on the opposite sides of the free region 141 and extend in the circumferential direction of the ring portion 111. The free region 141 maintains a wedge member 12 in a free state in which the wedge member 12 moves freely relative to the outer circumferential surface of the fastening member 2. Each of the left-hand and right-hand wedge regions 142 and 143 maintains the wedge member 12 in a caught state in which the wedge member 12 is caught by the outer circumferential surface of the fastening member 2.

The changeover mechanism 15 is adapted to operate the retainer 13 in order to move each wedge member 12 to a position at which the wedge member 12 faces the free region 141 of the corresponding wedge guide groove 14, a position at which the wedge member 12 faces the left-hand wedge region 142 of the corresponding wedge guide groove 14, or a position at which the wedge member 12 faces the right-hand wedge region 143 of the corresponding wedge guide groove 14.

As shown in FIGS. 4 and 5, the changeover mechanism 15 includes a changeover lever 152 which is mounted on the handle portion 112 at a position where the handle portion 112 merges into the ring portion 111, in such a manner that the lever can pivot horizontally. A first end portion 152*a* of the changeover lever 152 passes through the ring portion 111, and is coupled with the engagement portion 133 of the retainer 13. A positioning mechanism 16 is provided at a second end portion 152*b* of the changeover lever 152. The positioning mechanism 16 holds the changeover lever 152 at the selected one of three positions; i.e., a position at which the retainer 13 is moved to a circumferential position at which each wedge member 12 faces the corresponding free region 141, a position at which the retainer 13 is moved to a circumferential position at which each wedge member 12 faces the corresponding left-hand wedge region 142, and a position at which the retainer 13 is moved to a circumferential position at which each wedge member 12 faces the corresponding right-hand wedge region 143.

As shown in FIGS. 4 and 5, the positioning mechanism 16 is composed of a click stop mechanism which includes a steel ball 162 movably accommodated in a blind hole 161 formed in the second end portion 152*b* of the changeover lever 152, the second end portion 152*b* facing the handle portion 112 of the wrench body 11; a spring member 163 accommodated in the blind hole 161 in order to urge the steel ball 162 toward the handle portion 112; and three engagement holes 164*a* to 164*c* which are formed on the surface of the handle portion 112 and with which the steel ball 162 selectively engages. The positions and intervals of the engagement holes 164*a* to 164*c* are determined to enable the changeover lever 15 to be positioned at the above-described three positions.

Of the three engagement holes 164*a* to 164*c*, the engagement hole 164*a* is used to position the retainer 13 at a neutral position N at which each wedge member 12 faces the corresponding free region 141; the engagement hole 164*b* is used to position the retainer 13 at a tightening position L at which each wedge member 12 faces the corresponding left-hand wedge region 142; and the engagement hole 164*c* is used to position the retainer 13 at a loosening position UL at which each wedge member 12 faces the corresponding right-hand wedge region 143.

Next, operation of the wrench 10 having the above-described configuration will be described.

When a fastening member 2 is to be tightened, the changeover lever 152 of the changeover mechanism 15 is first rotated to the neutral position N in order to cause the steel ball 162 of the positioning mechanism 16 to engage the engagement hole 164*a*. In this state, each of the wedge members 12 held by the retainer 13 is caused to face the free region 141 of the corresponding wedge guide groove 14, as shown in FIG. 7A, so that each of the wedge members 12 enters a free state.

Subsequently, the ring portion 111 of the wrench body 11 is engaged with the fastening member 2, and then the changeover lever 152 of the changeover mechanism 15 is rotated to the tightening position L. As a result, each of the wedge members 12 held by the retainer 13 is caused to face the left-hand wedge region 142 of the corresponding wedge guide groove 14, as shown in FIG. 7B. Therefore, when the wrench body 11 is rotated in the direction of arrow A (clockwise) in FIG. 7B, each wedge member 12 is caught between the wall surface of the left-hand wedge region 142 and the outer circumferential surface of the fastening member 2. As a result, the ring portion 111 of the wrench body 11 is united with the fastening member 2, and the fastening member 2 can be tightened through an operation of rotating the wrench 10 in the direction of arrow A.

When the wrench 10 is to be removed from the fastening member 2 after completion of tightening of the fastening member 2, the wrench body 11 is rotated slightly in the direction opposite the direction of arrow A of FIG. 7B in order to release each wedge member 12 from the caught state established between the wall surface of the left-hand wedge region 142 and the outer circumferential surface of the fastening member 2. As a result, the wrench 10 can be easily removed from the fastening member 2.

Notably, the changeover lever 152 of the changeover mechanism 15 may be rotated to the neutral position N after the wedge members 12 are released from the caught state. In this case, the operation of removing the wrench 10 from the fastening member 2 becomes easier.

When the fastening member 2 is to be loosened, as in the case where the fastening member 2 is to be tightened, the changeover lever 152 of the changeover mechanism 15 is first rotated to the neutral position N in order to cause the steel ball 162 of the positioning mechanism 16 to engage the engagement hole 164*a*. In this state, each of the wedge members 12 held by the retainer 13 is caused to face the free region 141 of the corresponding wedge guide groove 14, so that each of the wedge members 12 enters a free state.

Subsequently, the ring portion 111 of the wrench body 11 is engaged with the fastening member 2, and then the changeover lever 152 of the changeover mechanism 15 is rotated to the loosening position UL. As a result, each of the wedge members 12 held by the retainer 13 is caused to face the right-hand wedge region 143 of the corresponding wedge guide groove 14, as shown in FIG. 7C. Therefore, when the wrench body 11 is rotated in the direction of arrow B (counterclockwise) in FIG. 7C, each wedge member 12 is caught between the wall surface of the right-hand wedge region 143 and the outer circumferential surface of the fastening member 2. As a result, the ring portion 111 of the wrench body 11 is united with the fastening member 2, and the fastening member 2 can be loosened through an operation of rotating the wrench 10 in the direction of arrow B.

When the wrench 10 is to be removed from the fastening member 2 after completion of loosening of the fastening member 2, the wrench body 11 is rotated slightly in the direction opposite the direction of arrow B of FIG. 7C in order to release each wedge member 12 from the caught state established between the wall surface of the right-hand wedge region 143 and the outer circumferential surface of the fastening member 2. As a result, the wrench 10 can be easily removed from the fastening member 2.

Notably, the changeover lever 152 of the changeover mechanism 15 may be rotated to the neutral position N after the wedge members 12 are released from the caught state. In this case, the operation of removing the wrench 10 from the fastening member 2 becomes easier.

In the wrench 10 according to the present embodiment, the retainer 13, which holds the plurality of wedge members 12 arranged in the circumferential direction of the ring portion 111, is disposed inside the ring portion 111 to rotate along the inner circumferential surface of the ring portion 111; the wedge guide grooves 14 are formed on the inner circumferential surface of the ring portion 111 to be arranged at intervals corresponding to those of the wedge members 12, wherein each of the wedge guide grooves 14 has a free region 141 for maintaining a wedge member 12 in a free state in which the wedge member 12 moves freely relative to the outer circumferential surface of the fastening member 2, and left-hand and right-hand wedge regions 142 and 143, each maintaining the wedge member 12 in a caught state in which the wedge member 12 is caught by the outer circumferential surface of the fastening member 2; the changeover mechanism 15 for operating the retainer 13 is provided on the wrench body 11; and, by means of the changeover mechanism 15, the retainer 13 is moved to the position at which each wedge member 12 faces the free region 141 of the corresponding wedge guide groove 14, the position at which each wedge member 12 faces the left-hand wedge region 142 of the corresponding wedge guide groove 14, or the position at which each wedge member 12 faces the right-hand wedge region 143 of the corresponding wedge guide groove 14. Therefore, each wedge member 12 can be positioned, in a reliable and stable manner, to the position at which the wedge member 12 faces the corresponding free region 141, the position at which the wedge member 12 faces the corresponding left-hand wedge region 142, or the position at which the wedge member 12 faces the corresponding right-hand wedge region 143. In addition, all the wedge members 12 can be simultaneously held in a free state or a caught state. Therefore, tightening and loosening of the fastening member 2 by use of the wrench 10 can be performed without any problem. Moreover, the work for tightening and loosening of the fastening member 2 can be facilitated, and thereby improving work efficiency.

In the present embodiment, since the changeover mechanism 15 is provided with the positioning mechanism 16 of a click-stop configuration, each wedge member 12 can be positioned, in a more reliable and stable manner, to the position at which the wedge member 12 faces the corresponding free region 141, the position at which the wedge member 12 faces the corresponding left-hand wedge region 142, or the position at which the wedge member 12 faces the corresponding right-hand wedge region 143.

Further, since the changeover mechanism 15 has the changeover lever 152 connected to the retainer 13, all the wedge members 12 can be easily brought into the free state or the caught state through a simple operation of rotating the retainer 13 by use of the changeover lever 152.

Next, a second embodiment of the present invention will be described with reference to FIG. 8 to FIG. 11C.

Figure 8:
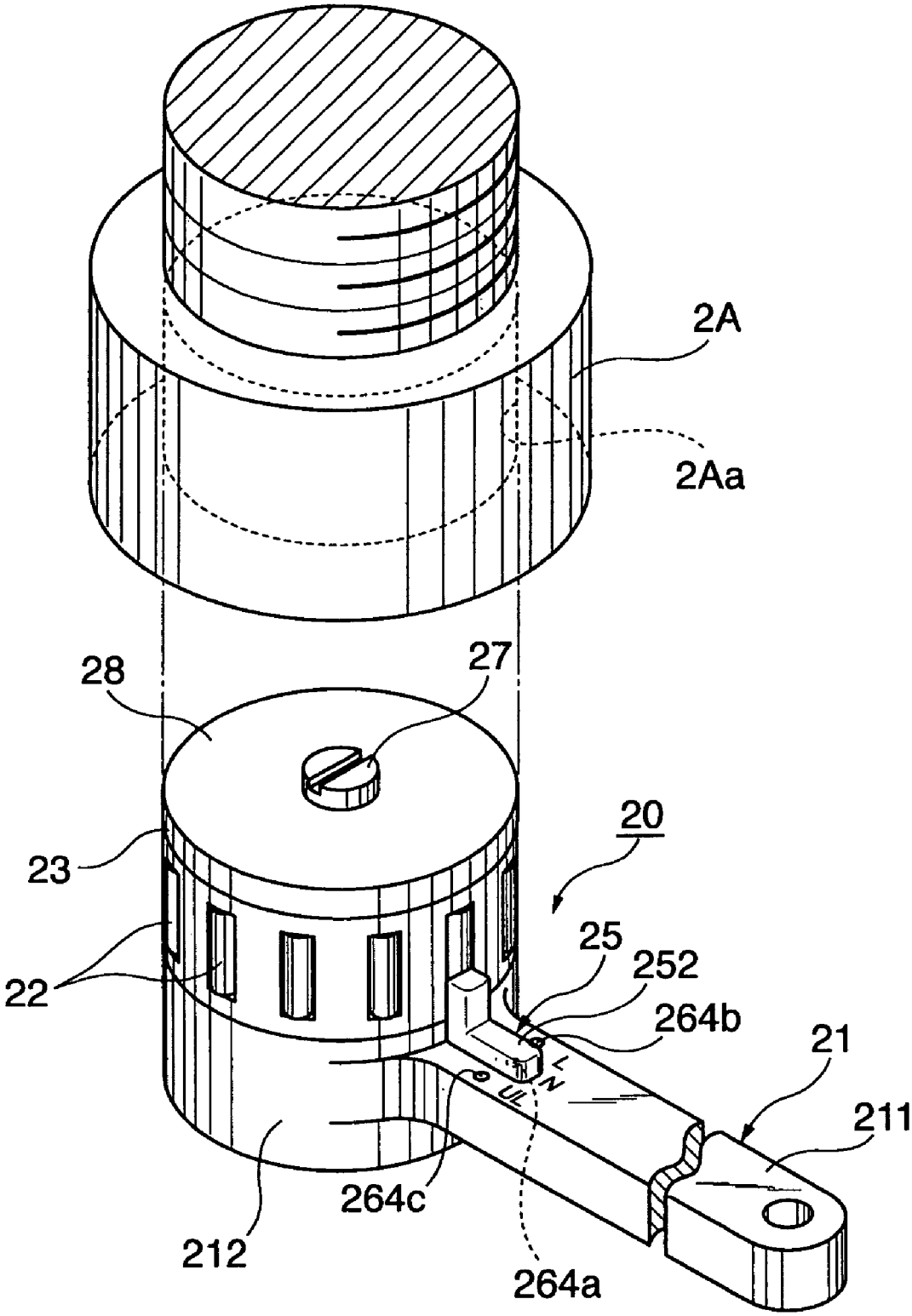
FIG. 8 is a perspective view of a wrench according to a second embodiment of the present invention.
Figure 9:
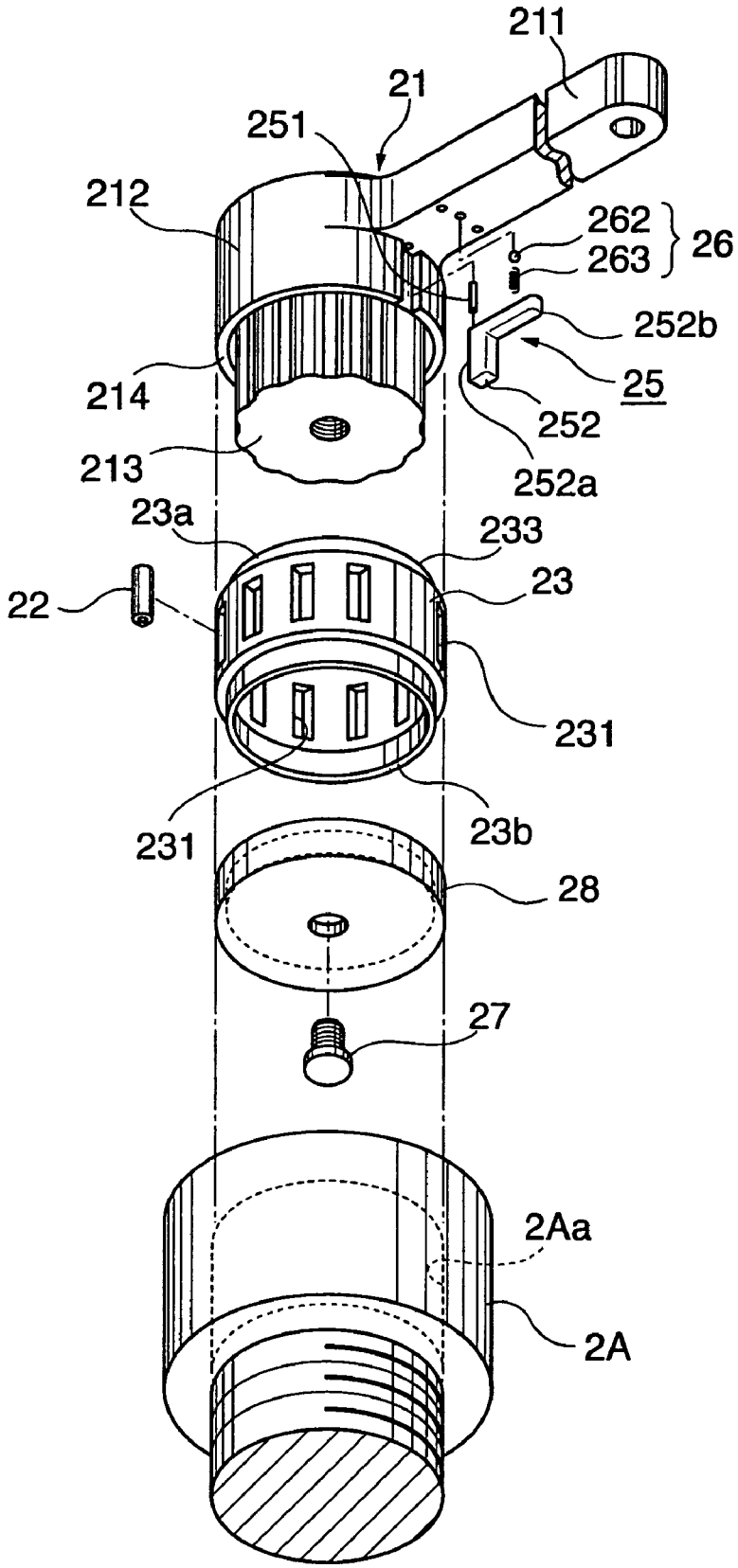
FIG. 9 is an exploded perspective view of the wrench according to the second embodiment.
Figure 10:
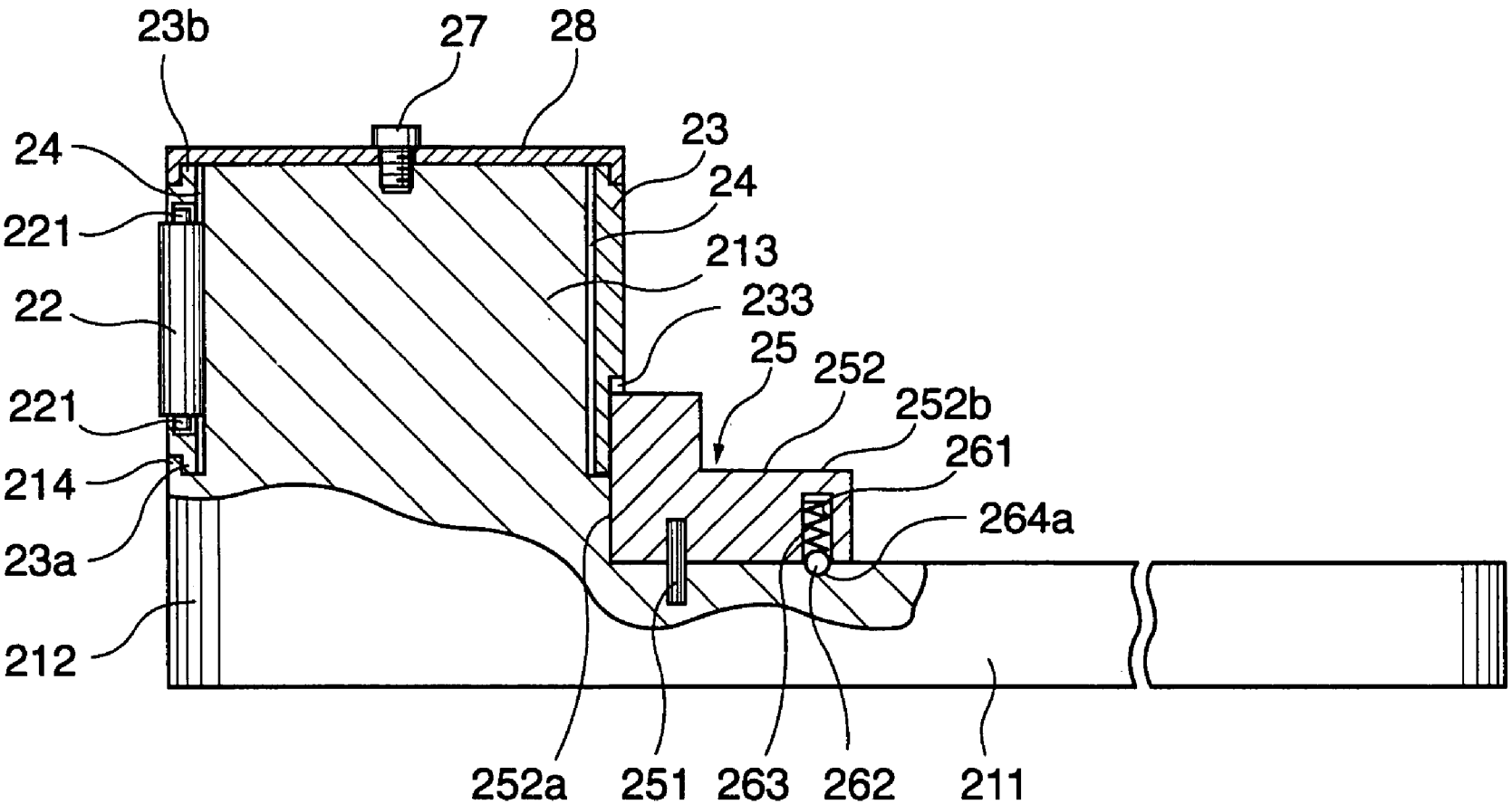
FIG. 10 is an enlarged cross-sectional view of a portion of the wrench according to the second embodiment.

A wrench 20 shown in FIGS. 8 to 10 is adapted to be engaged with a cylindrical hole 2Aa of a fastening member 2A, such as a bolt having a cylindrical hole in its head portion, in order to tighten or loosen the fastening member 2A with respect to another member. The wrench 20 includes a wrench body 21, wedge members 22, a retainer 23, wedge guide grooves 24, and a changeover mechanism 25.

The wrench body 21 has a handle portion 211, a cylindrical base portion 212 provided at one end of the handle portion 211, and a cylindrical body 213 concentrically provided on one end surface of the cylindrical base portion 212 and having a diameter smaller than that of the base portion 212. A fitting portion 214 for rotatably supporting one end of the retainer 23 is formed at a step portion between the base portion 212 and the cylindrical body 213.

As shown in FIGS. 8 to 11C, the wedge members 22 each assume a roller-like shape. When the fastening member 2A is tightened or loosened by means of the wrench body 21, each of the wedge members 22 is caught between the outer circumferential surface of the cylindrical body 213 and the inner circumference of the fastening member 2A to thereby couple the cylindrical body 213 and the fastening member 2A.

The retainer 23 is adapted to hold the wedge members 22 at uniform intervals along the outer circumferential surface of the cylindrical body 213. As shown in FIGS. 9 and 10, the retainer 23 assumes a cylindrical, tubular shape, and has an inner diameter corresponding to the diameter of the cylindrical body 213 and an outer diameter corresponding to the diameter of the cylindrical hole 2Aa of the fastening member 2A. The retainer 23 has a wall thickness-smaller than the diameter of the roller-shaped wedge members 22. Annular support portions 23*a* and 23*b* are formed at opposite ends, respectively, of the retainer 23, and are used to support the retainer 23 in such a manner that the retainer 23 rotates around the outer circumference of the cylindrical body 213.

Specifically, after the retainer 23.1*s* fitted onto the cylindrical body 213, one annular support portion 23*a* is fitted into the fitting portion 214 of the base portion 212, and the other annular support portion 23*b* is fitted into a cap-shaped support member 28, which is fixed to a lower end of the cylindrical body 213 (as viewed in FIG. 9) by use of a screw 27. Thus, the retainer 23 is supported in such a manner that the retainer 23 can rotate around the outer circumference of the cylindrical body 213.

As shown in FIGS. 9 to 11C, elongated holes 231 for accommodating the wedge members 22 are formed in the retainer 23 at eleven of twelve locations which are determined, for example, by dividing the circumference of the retainer 23 at predetermined intervals of 30 degrees. The elongated holes 231 extend parallel to the axis of the retainer 23. Each wedge member 22 is movably held in the corresponding elongated hole 231 in such a manner that the wedge member 22 can be rotated about its axis. Contrary to the first embodiment, the wedge members 22 are supported in such a manner that the wedge members 22 are prevented from coming off toward the exterior of the retainer 23. An engagement portion 233 to which the changeover mechanism 25 is coupled is formed at the one remaining location of the above-described twelve locations.

The wedge guide grooves 24 are adapted to maintain the wedge members 22 in a free state in which the wedge members 22 move freely between the bottoms of the wedge guide grooves 24 and the inner circumferential surface of the cylindrical hole 2Aa of the fastening member 2A and to maintain the wedge members 22 in a caught state in which the wedge members 22 are caught between the bottoms of the wedge guide grooves 24 and the inner circumferential surface of the cylindrical hole 2Aa of the fastening member 2A. The wedge guide grooves 24 are formed on the outer circumferential surface of the cylindrical body 213 to be arranged along the circumferential direction of the cylindrical body 213 at intervals corresponding to those of the wedge members 22.

Figure 11A:
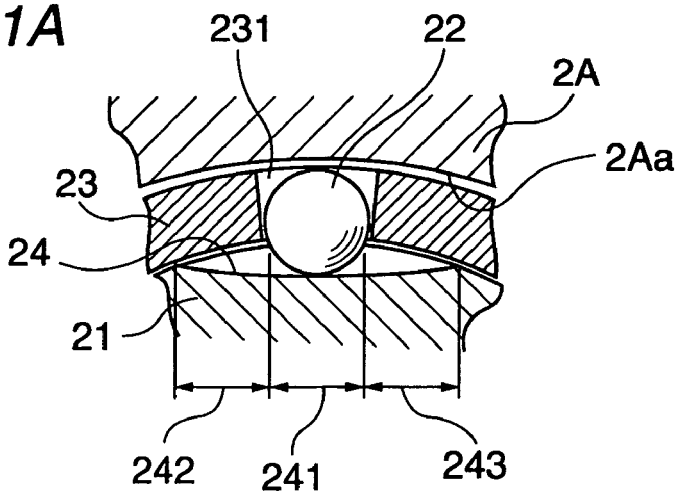
FIGS. 11A to 11C are enlarged cross-sectional views each showing the relation between a wedge member and a wedge guide groove of the wrench according to the second embodiment.
Figure 11B:
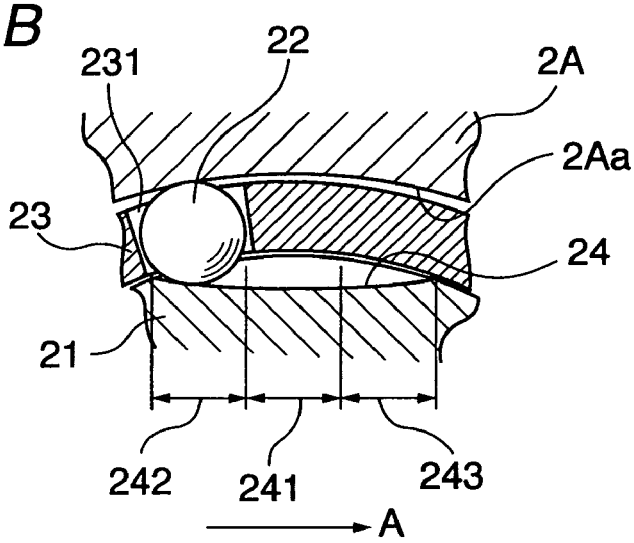
Figure 11C:
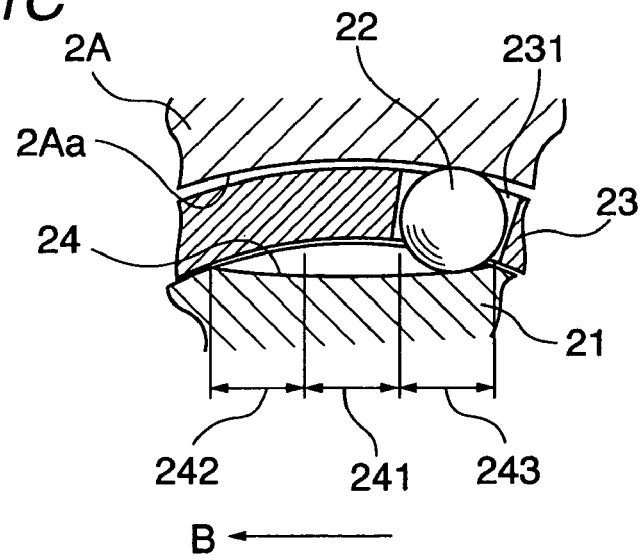

As shown in FIGS. 11A to 11C, each of the wedge guide grooves 24 has a free region 241, and left-hand and right-hand wedge regions 242 and 243 which are provided on the opposite sides of the free region 241 and extend in the circumferential direction of the cylindrical body 213. The free region 241 maintains a wedge member 22 in a free state in which the wedge member 22 moves freely relative to the inner circumferential surface of the cylindrical hole 2Aa of the fastening member 2A. Each of the left-hand and right-hand wedge regions 242 and 243 maintains the wedge member 22 in a caught state in which the wedge member 22 is caught by the inner circumferential surface of the cylindric hole 2Aa of the fastening member 2A.

The changeover mechanism 25 is adapted to operate the retainer 23 in order to move each wedge member 22 to a position at which the wedge member 22 faces the free region 241 of the corresponding wedge guide groove 24, a position at which the wedge member 22 faces the left-hand wedge region 242 of the corresponding wedge guide groove 24, or a position at which the wedge member 22 faces the right-hand wedge region 243 of the corresponding wedge guide groove 24.

As shown in FIGS. 9 and 10, the changeover mechanism 25 includes a changeover lever 252 which is mounted on the handle portion 211 at a position where the handle portion 211 merges into the base portion 212, in such a manner that the changeover lever 252 can pivot horizontally. A first end portion 252*a* of the changeover lever 252 is coupled with the engagement portion 233 of the retainer 23. A positioning mechanism 26 is provided at a second end portion 252*b* of the changeover lever 252. The positioning mechanism 26 holds the changeover lever 252 at the selected one of three positions; i.e., a position at which the retainer 23 is moved to a circumferential position at which each wedge member 22 faces the corresponding free region 241, a position at which the retainer 23 is moved to a circumferential position at which each wedge member 22 faces the corresponding left-hand wedge region 242, and a position at which the retainer 23 is moved to a circumferential position at which each wedge member 22 faces the corresponding right-hand wedge region 243.

As shown in FIGS. 9 and 10, the positioning-mechanism 26 is composed of a click stop mechanism which includes a steel ball 262 movably accommodated in a blind hole 261 formed in the second end portion 252*b* of the changeover lever 252, the second end portion 252*b* facing the handle portion 211 of the wrench body 21; a spring member 263 accommodated in the blind hole 261 in order to urge the steel ball 262 toward the handle portion 211; and three engagement holes 264*a* to 264*c* which are formed on the surface of the handle portion 211 and with which the steel ball 262 selectively engages. The positions and intervals of the engagement holes 264*a* to 264*c* are determined to enable the changeover lever 25 to be positioned at the above-described three positions.

Of the three engagement holes 264*a* to 264*c*, the engagement hole 264*a* is used to position the retainer 23 at a neutral position N at which each wedge member 22 faces the corresponding free region 241; the engagement hole 264*b* is used to position the retainer 23 at a tightening position L at which each wedge member 22 faces the corresponding left-hand wedge region 242; and the engagement hole 264*c* is used to position the retainer 23 at a loosening position UL at which each wedge member 22 faces the corresponding right-hand wedge region 243.

Next, operation of the wrench 20 having the above-described configuration will be described.

When the fastening member 2A is to be tightened, the changeover lever 252 of the changeover mechanism 25 is first rotated to the neutral position N in order to cause the steel ball 262 of the positioning mechanism 26 to engage the engagement hole 264*a*. In this state each of the wedge members 22 held by the retainer 23 is caused to face the free region 241 of the corresponding wedge guide groove 24, as shown in FIG. 11A, so that each of the wedge members 22 enters a free state.

Subsequently, the cylindrical body 213 of the wrench body 21, together with the retainer 23, is engaged with the cylindrical hole 2Aa of the fastening member 2A, and then the changeover lever 252 of the changeover mechanism 25 is rotated to the tightening position L. As a result, each of the wedge members 22 held by the retainer 23 is caused to face the left-hand wedge region 242 of the corresponding wedge guide groove 24, as shown in FIG. 11B. Therefore, when the wrench body 21 is rotated in the direction of arrow A (clockwise) of FIG. 11B, each wedge member 22 is caught between the wall surface of the left-hand wedge region 242 and the inner circumferential surface of the cylindrical hole 2Aa of the fastening member 2A. As a result, the cylindrical body 213 of the wrench body 21 is united with the fastening member 2A, and the fastening member 2A can be tightened through an operation of rotating the wrench 20 in the direction of arrow A.

Figure 1:
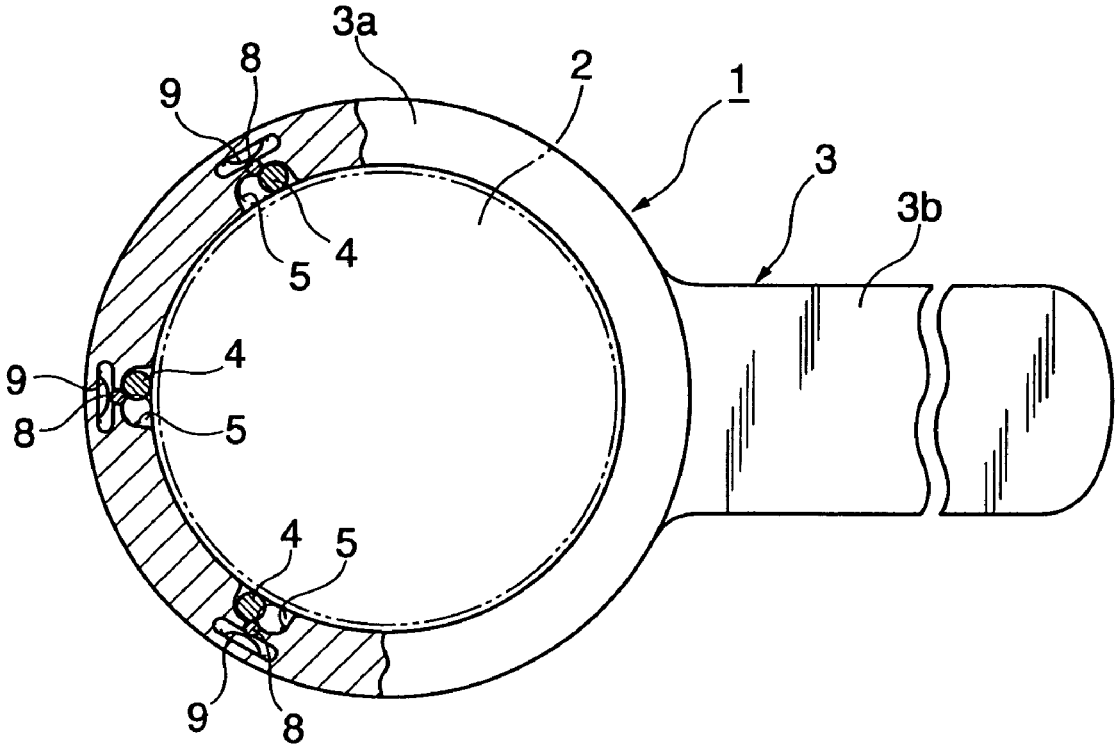
FIG. 1 PRIOR ART
FIG. 1 is a partially cut-away plan view of a conventional wrench.
Figure 2:
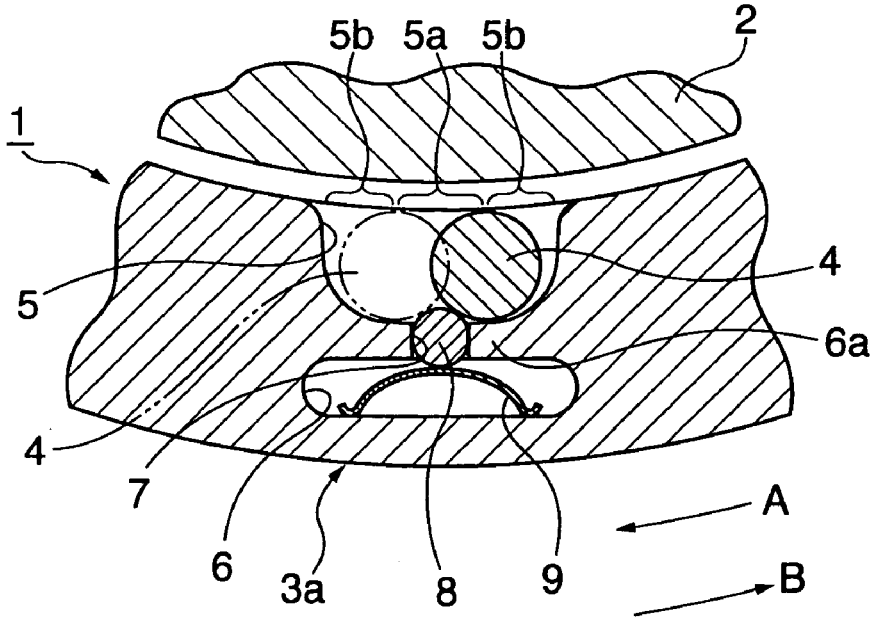
FIG. 2 PRIOR ART
FIG. 2 is an enlarged cross-sectional view of the conventional wrench, showing the relation between a wedge member and a groove.

When the wrench 20 is to be removed from the fastening member 2A after completion of tightening of the fastening member 2A, the wrench body 21 is rotated slightly in the direction opposite the direction of arrow A of FIG. 1B in order to release each wedge member 22 from the caught state established between the wall surface of the left-hand wedge region 242 and the inner circumferential surface of the cylindrical hole 2Aa of the fastening member 2A. As a result, the wrench 20 can be easily removed from the fastening member 2A.

Notably, the changeover lever 252 of the changeover mechanism 25 may be rotated to the neutral position N after the wedge members 22 are released from the caught state. In this case, the operation of removing the wrench 20 from the fastening member 2A becomes easier.

When the fastening member 2A is to be loosened, as in the case where the fastening member 2A is to be tightened, the changeover lever 252 of the changeover mechanism 25 is first rotated to the neutral position N in order to cause the steel ball 262 of the positioning mechanism 26 to engage the engagement hole 264*a*. In this state, each of the wedge members 22 held by the retainer 23 is caused to face the free region 241 of the corresponding wedge guide groove 24, whereby each of the wedge members 22 enters a free state.

Subsequently, the cylindrical body 213 of the wrench body 21, together with the retainer 23, is engaged with the cylindrical hole 2Aa of the fastening member 2A, and then the changeover lever 252 of the changeover mechanism 25 is rotated to the loosening position UL. As a result, each of the wedge members 22 held by the retainer 23 is caused to face the right-hand wedge region 243 of the corresponding wedge guide groove 24, as shown in FIG. 1C. Therefore, when the wrench body 21 is rotated in the direction of arrow B (counterclockwise) in FIG. 11C, each wedge member 22 is caught between the wall surface of the right-hand wedge region 243 and the inner circumferential surface of the cylindrical hole 2Aa of the fastening member 2A. As a result, the cylindrical body 213 of the wrench body 21 is united with the fastening member 2A, and the fastening member 2A can be loosened through an operation of rotating the wrench 20 in the direction of arrow B.

When the wrench 20 is to be removed from the fastening member 2A after completion of loosening of the fastening member 2A, the wrench body 21 is rotated slightly in the direction opposite the direction of arrow B of FIG. 11C in order to release each wedge member 22 from the caught state established between the wall surface of the right-hand wedge region 243 and the inner circumferential surface of the cylindrical hole 2Aa of the fastening member 2A. As a result, the wrench 20 can be easily removed from the fastening member 2A.

Notably, the changeover lever 252 of the changeover mechanism 25 may be rotated to the neutral position N after the wedge members 22 are released from the caught state. In this case, the operation of removing the wrench 20 from the fastening member 2A becomes easier.

In the wrench 20 according to the present embodiment, the retainer 23, which holds the plurality of wedge members 22 arranged in the circumferential direction of the cylindrical body 213, is disposed outside the cylindrical body 213 to rotate around the outer circumferential surface of the cylindrical body 213; the wedge guide grooves 24 are formed on the outer circumferential surface of the cylindrical body 213 to be arranged at intervals corresponding to those of the wedge members 22, wherein each of the wedge guide grooves 24 has a free region 241 for maintaining a wedge member 22 in a free state in which the wedge member 22 moves freely relative to the inner circumferential surface of the cylindrical hole 2Aa of the fastening member 2A, and left-hand and right-hand wedge regions 242 and 243, each maintaining the wedge member 22 in a caught state in which the wedge member 22 is caught by the inner circumferential surface of the cylindrical hole 2Aa of the fastening member 2A; the changeover mechanism 25 for operating the retainer 23 is provided on the wrench body 21; and, by means of the changeover mechanism 25, the retainer 23 is moved to the position at which each wedge member 22 faces the free region 241 of the corresponding wedge guide groove 24, the position at which each wedge member 22 faces the left-hand wedge region 242 of the corresponding wedge guide groove 24, or the position at which each wedge member 22 faces the right-hand wedge region 243 of the corresponding wedge guide groove 24. Therefore, each wedge member 22 can be positioned, in a reliable and stable manner, to the position at which the wedge member 22 faces the corresponding free region 241, the position at which the wedge member 22 faces the corresponding left-hand wedge region 242, or the position at which the wedge member 22 faces the corresponding right-hand wedge region 243. In addition, all the wedge members 22 can be simultaneously held in a free state or a caught state. Therefore, tightening and loosening of the fastening member 2A having the cylindrical hole 2Aa by use of the wrench 20 can be performed without any problem. Moreover, the work for tightening and loosening of the fastening member 2A can be facilitated, thereby improving work efficiency.

In the present embodiment, since the changeover mechanism 25 is provided with the positioning mechanism 26 of a click-stop configuration, each wedge member 22 can be positioned, in a more reliable and stable manner, to the position at which the wedge member 22 faces the corresponding free region 241, the position at which the wedge member 22 faces the corresponding left-hand wedge region 242, or the position at which the wedge member 22 faces the corresponding right-hand wedge region 243.

Further, since the changeover mechanism 25 has the changeover lever 252 connected to the retainer 23, all the wedge members 22 can be easily brought into the free state or the caught state through a simple operation of rotating the retainer 23 by use of the changeover lever 252.

The changeover mechanisms 15 and 25 of the present invention are not limited to those having structures shown in the above-described embodiments. For example, a changeover lever different from those used in the above-described embodiments may be connected directly to the retainer 13 (23), and through operation of this changeover lever, each wedge member 12 (22) may be positioned to the position at which the wedge member 12 (22) faces the corresponding free region 141 (241), the position at which the wedge member 12 (22) faces the corresponding left-hand wedge region 142 (242), or the position at which the wedge member 12 (22) faces the corresponding right-hand wedge region 143 (243).

Further, the positioning mechanisms 16 and 26 of the changeover mechanisms 15 and 25 of the above-described embodiments may be omitted.

Moreover, in the above-described embodiments, the wedge guide grooves 14 of the ring portion 111 and the wedge guide grooves 24 of the cylindrical body 213 are each composed of the free region 141 or 241, the left-hand wedge region 142 or 242, and the right-hand wedge region 143 or 243. However, the present invention is not limited thereto, and each of the wedge guide grooves 14 or 24 may be composed of a free region and a single wedge region on the left-hand or right-hand side.

Obviously, numerous modifications and variations of the present invention are possible in light of the above teachings. It is therefore to be understood that within the scope of the appended claims, the present invention may be practiced otherwise than as specifically described herein.

The invention claimed is:

1. A wrench for tightening or loosening a fastening member having a cylindrical hole with respect to another member, comprising:

a wrench body having a cylindrical body to be inserted into the cylindrical hole of the fastening member and a handle portion projecting from the cylindrical body;

a plurality of wedge members each assuming a roller-like shape;

a retainer disposed outside the cylindrical body in such a manner that the retainer rotates around an outer circumferential surface of the cylindrical body, the retainer rotatably holding the wedge members at predetermined intervals in a circumferential direction of the cylindrical body;

wedge guide grooves formed on the outer circumferential surface of the cylindrical body to be arranged along the circumferential direction of the cylindrical body at intervals corresponding to those of the wedge members, each of the wedge guide grooves having a free region which extends in the circumferential direction of the cylindrical body and maintains the corresponding wedge member in a free state in which the wedge member moves freely between a bottom surface of the corresponding wedge guide groove and the inner circumferential surface of the cylindrical hole of the fastening member, and a wedge region which extends in the circumferential direction of the cylindrical body and maintains the corresponding wedge member in a caught state in which the wedge member is caught between the bottom surface of the corresponding wedge guide groove and the inner circumferential surface of the cylindrical hole of the fastening member; and a changeover mechanism for operating the retainer in order to move each wedge member to a position at which the wedge member faces the free region of the corresponding wedge guide groove or a position at which the wedge member faces the wedge region of the corresponding wedge guide groove.

2. A wrench according to claim 1, wherein the wedge region of each of the wedge guide grooves is provided on each of opposite sides of the free region with respect to the circumferential direction of the cylindrical body.

3. A wrench according to claim 1, wherein the changeover mechanism includes a changeover lever for operating the retainer.

4. A wrench according to claim 1, wherein the changeover mechanism includes a changeover lever mounted on the handle portion at a position near the cylindrical body in such a manner that the lever can pivot horizontally; a first end portion of the changeover lever is coupled to the retainer; a positioning mechanism is provided at a second end portion of the changeover lever in order to hold the changeover lever at a position at which the retainer is moved to a circumferential position at which each wedge member faces the corresponding free region or a position at which the retainer is moved to a circumferential position at which each wedge member faces the corresponding wedge region.

5. A wrench according to claim 4, wherein the positioning mechanism is composed of a click stop mechanism which includes a steel ball accommodated in the second end portion of the changeover lever; a spring member for urging the steel ball toward the handle portion; and first and second engagement holes which are formed on the surface of the handle portion and with which the steel ball selectively engages, wherein when the steel ball engages the first engagement hole, the retainer is positioned at the circumferential position at which each wedge member faces the corresponding free region, and when the steel ball engages the second engagement hole, the retainer is positioned at the circumferential position at which each wedge member faces the corresponding wedge region.

* * * * *